United States Patent [19]

Matsuo et al.

[11] 4,139,380

[45] Feb. 13, 1979

[54] ELECTROPHOTOGRAPHIC SENSITIVE MATERIAL WITH RUBBER INTERLAYER

[75] Inventors: Minoru Matsuo; Katutoshi Endo, both of Tokyo, Japan

[73] Assignee: Ricoh Company, Ltd., Tokyo, Japan

[21] Appl. No.: 747,414

[22] Filed: Dec. 6, 1976

[30] Foreign Application Priority Data

Dec. 10, 1975 [JP] Japan ..... 50-147191

[51] Int. Cl.[2] ..... G03G 5/08; G03G 5/14

[52] U.S. Cl. ..... 96/1.5 R; 96/1.8

[58] Field of Search ..... 96/1.8, 1.5, 1.3

[56] References Cited

U.S. PATENT DOCUMENTS

| | | | |
|---|---|---|---|
| 2,901,348 | 8/1959 | Dessauer et al. | 96/1.5 |
| 3,121,006 | 2/1964 | Middleton et al. | 96/1.5 |
| 3,468,660 | 9/1969 | Davenport et al. | 96/1.8 |
| 3,697,265 | 10/1972 | Teuscher et al. | 96/1.5 |

FOREIGN PATENT DOCUMENTS

| | | | |
|---|---|---|---|
| 4915218 | 3/1974 | Japan | 96/1.5 |
| 4946263 | 9/1974 | Japan | 96/1.5 |

*Primary Examiner*—Roland E. Martin, Jr.
*Assistant Examiner*—John L. Goodrow
*Attorney, Agent, or Firm*—Blanchard, Flynn, Thiel, Boutell & Tanis

[57] ABSTRACT

Disclosed herein is a photosensitive material for use in electrophotography which comprises a support, a photoconductive layer, and an adhesive layer consisting mainly of chloroprene rubber and/or nitrile rubber, said adhesive layer being interposed in between said support and photoconductive layer. A photosensitive material of this type manifests a satisfactory adhesion between the support and the photoconductive layer as well as excellent flexibility, and inasmuch as said adhesive layer will not interfere with the leaking of charge, it always renders a clear-cut copied image.

10 Claims, 4 Drawing Figures

ELECTROPHOTOGRAPHIC SENSITIVE MATERIAL WITH RUBBER INTERLAYER

BACKGROUND OF THE INVENTION (a) Field of the Invention

The present invention relates to a photosensitive material for use in electrophotography.

(b) Description of the Prior Art

A typical one of the known copying processes in electrophotography is Carlson's process. According to this process, a photosensitive material is first charged with electricity in a dark place and then exposed to light. By this exposure, the photoconductivity of the photoconductor changes, the electric charge of the portion radiated with light leaks to the side of support (to wit, base plate side), and as a result, a latent image corresponding to the difference of the density of charge is formed on the surface of the photosensitive material. Subsequently, this latent image is turned into a visible image by means of a developer (developing powder), and said developing powder is next transferred to a transfer material, such as paper, and is fixed thereon by such means as heating or the like.

To cite the electrophotographic sensitive material known from the outset for use in said Carlson's process, there is one prepared by forming a photoconductive layer on a conductive support. This photosensitive material has thereafter been improved, and a photosensitive material provided with double photoconductive layer, a photosensitive material comprising an insulating layer formed on the photoconductive layer and so forth have been developed with the progress of the electrophotographic process.

However, with the recent marked tendency toward high-speed electrophotographic copying machines, there is a need for improvements of both the sensitivity of photosensitive materials and the durability thereof. For the improvement of the durability of photosensitive materials, it is of course necessary to enhance the mechanical strength of the photoconductive layer per se, but the enchancement of the strength of adhesion between the photoconductive layer and the support is necessary as well. For instance, in the case where the photosensitive material is used in the form of a belt, in order to make the flexibility of photoconductive layer satisfactory, the adhesion between the photoconductive layer and the support must be firm and strong.

From this standpoint, with a view to strengthening the adhesion between the photoconductive layer and the support, there have been proposed various photosensitive materials comprising an intermediate layer (or adhesive layer) consisting of resin formed inbetween the photoconductive layer and the support. For instance, in the specification for U.S. Pat. No. 2,901,348 and Japanese Patent Publication No. 32468/1969 are cited polyvinyl acetal, phenol resin, cellulose lacquer, alkyd resin, polyvinyl carbazole, polyester, polysulfide resin, polyurethane, amino resin, polyvinyl alcohol, silicone resin, polystyrene, chlorinated rubber, epoxide resin, polysulfide silicone resin, polyamide, polysulfide modified epoxide resin, etc. as the resin to constitute said adhesive layer. However, inasmuch as an adhesive layer (or intermediate layer) consisting of such a resin alone would interfere with the leaking of the charge, although it is admittedly effective as the barrier layer of a photosensitive material having a great value of dark decay, in the case of a photosensitive material having a small value of dark decay, it is unsuitable because it will bring about deterioration of sensitivity and will give rise to residual potential.

As a means for eliminating the foregoing defect, it has been proposed to provide an adhesive layer consisting of polyvinyl acetate containing carbon black as the resistance controlling additive inbetween a conductive support and a selenium layer (cf. Japanese Patent Open No. 47631/1975). However, addition of such an additive as carbon black will change the properties of the resin, entailing deterioration of the adhesive property thereof and inferiority of the characteristics of the resulting image owing to the lack of uniformity of dispersion of said additive depending on the mixing ratio thereof, and it will become extremely difficult to determine the conditions for manufacturing a photosensitive material. Besides, the resulting photosensitive material does not come up to the standard intended by the present inventors.

SUMMARY OF THE INVENTION

A principal object of the present invention is to eliminate the aforesaid drawbacks of the prior art, improve the adhesion between the photoconductive layer and the support and provide an electrophotographic sensitive material which has an adhesive layer that does not interfere with the leaking of electric charge and demonstrates a satisfactory flexibility. Another object of the present invention is to provide an electrophotographic sensitive material which has excellent electric characteristics and always renders a clear-cut copied image. The wording 'excellent electric characteristics' herein means that the photosensitive material is free from the lowering of charged potential and the deterioration of sensitivity ascribable to the provision of the intermediate layer (or adhesive layer) and gives rise to little increase of residual potential even when used repeatedly.

To be precise, the present invention relates to an electrophotographic sensitive material comprising an intermediate layer (to wit, adhesive layer), a photoconductive layer consisting mainly of selenium or selenium compound, and, if necessary, a layer of insulating material, said layers being stratified in order on a support, wherein said intermediate layer (adhesive layer) is a thin layer consisting essentially of either one of chloroprene rubber and nitrile rubber or a blend of both rubbers.

In addition, as another mode of electrophotographic sensitive material according to the present invention, there can be cited a photosensitive material wherein said intermediate layer is composed of a thin layer consisting of at least one member of the group consisting of chloroprene rubber and nitrile rubber as blended with at least one member of the group consisting of polyesters and epoxide resins.

BRIEF DESCRIPTION OF THE DRAWING

The appended drawings

DETAILED DESCRIPTION OF THE INVENTION

Figure 1:
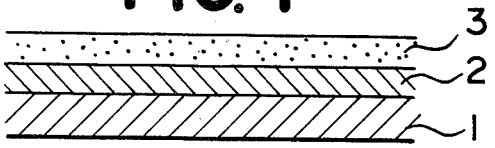
FIG. 1 through FIG. 4 are respectively cross-sectional views — on an enlarged scale — of a part of various electrophotographic sensitive materials according to the present invention. In the reference numerals thereon, 1 denotes a support, 2 denotes an intermediate layer, 3 and 3' denote photoconductive layers, respectively, and 4 denotes an insulating layer. In the present invention, the intermediate layer 2, to wit, the adhesive layer, is interposed between the support 1 and the photoconductive layer 3 (or 3'). As the applicable material constituting the support 1 herein, a metal sheet having intrinsic flexibility and substantial tensile strength such as stainless steel sheet, nickel plate, etc. and a resin sheet having conductivity can be cited. And, the photoconductive layer herein is composed of one or more layers, and at least one layer thereof consists mainly of selenium or selenium compound. In this context, it is not always necessary to dispose the photoconductive layer 3' on the photoconductive layer 3 consisting mainly of selenium or selenium compound as illustrated in FIG. 3 and FIG. 4, that is, said photoconductive layer 3 may be disposed on said photoconductive layer 3'. As the photoconductor for use in forming this photoconductive layer 3 (or 3'), resinous binder type ones such as organic photoconductors, and ZnO, ZnS, CdS, etc., are applicable. The configuration of the support 1 is not limited to plate shape, drum shape, belt shape, sheet shape, etc.
Figure 2:
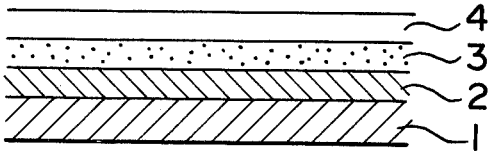
Figure 3:
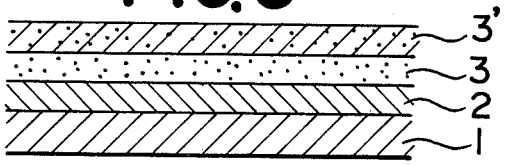
Figure 4:
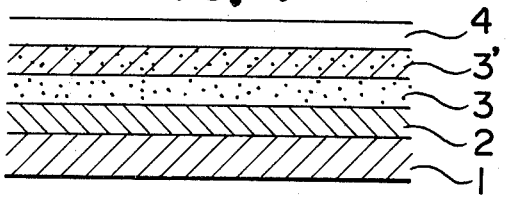

The intermediate layer 2 constituting the characteristic feature of the electrophotographic sensitive material of the present invention is, as discussed above, composed of either one of chloroprene rubber (CR) and nitrile rubber (NBR) or a blend of these rubbers. In the case of applying a blended rubber, any mixing ratio of CR to NBR can be adopted.

Further, this intermediate layer 2 can be composed of a blend of at least one member selected from the group of CR and NBR and at least one member selected from the group of polyesters and epoxide resins. In the case of applying this blend, the appropriate amount of the latter ingredient (to wit, polyester and/or epoxide resin) is in the range of 0.5–20 parts by weight based on 100 parts by weight of the former ingredient (to wit, CR and/or NBR).

It has hitherto been generally said that on the occasion of forming the intermediate layer 2 by applying a resin independently, when the thickness of the layer formed is not more than 0.1 $\mu$, the adhesion thereof will be insufficient while in the case where it is more than 1 $\mu$, the leaking of charge will be interfered with. For instance, when an electrophotographic sensitive material provided with an intermediate layer formed of polyvinyl acetate alone is charged with +6KV, its electric potential becomes as high as 300V per 1 micron, and in the case of an electrophotographic sensitive material prepared by coating said resin on a metal support made of aluminum or the like and depositing selenium thereon to the extent of 30–50 $\mu$ in thickness through vacuum evaporation, the residual potential comes up to as high as 150V. Accordingly, both are disqualified for practical use.

On the contrary, in the case of an electrophotographic sensitive material according to the present invention, the adhesion between the support 1 and the photoconductive layer 3 (or 3') through the intermediate layer (or adhesive layer) 2 is equivalent to or superior to that to be effected by polyvinyl acetate, and this sensitive material is practically free of residual potential and does not show accumulation of residual potential owing to repeated use thereof such as is seen in the case of polyvinyl acetate mixed with carbon black. The appropriate thickness of the intermediate layer for the present photosensitive material is in the range of 0.1–5 $\mu$.

The above discussed intermediate layer in the present invention, however, can contain a small amount of carbon black, but its content is in the range of less than 20% by weight. Addition of carbon black to this extent is effective for expediting the leaking of charge, but when it exceeds this range, it will cause the aforesaid lack of uniformity of dispersion and so on, and therefore it is undesirable. Even in the case of applying carbon black as above, the appropriate thickness of the intermediate layer 2 is still in the range of 0.1–5 $\mu$.

In order to prepare a photosensitive material of the present invention practically, it will do to follow the process comprising dissolving CR and/or NBR, for instance, in an appropriate solvent such as methyl ethyl ketone, toluene or the like, dipping a support in the resulting solution, drying the thus treated support to remove the solvent therefrom thereby forming an intermediate layer (or adhesive layer), and depositing selenium or the like thereon through vacuum evaporation. It also will do to follow the process comprising blending a solution prepared by dissolving CR and/or NBR, etc. and a solution prepared by dissolving polyester, epoxide resin and the like in an appropriate solvent such as tetrahydrofuran, toluene, ethyl acetate, methyl ethyl ketone or the like, and dipping a support in this blended solution.

The electrophotographic sensitive material according to the present invention has various merits such that (a) it does not give rise to residual potential, (b) it shows little fatigue and is stable even when used repeatedly, and (c) the thickness of the intermediate layer thereof has a wide range of selection so that the manufacture of the photosensitive material is easy.

The reason why the present electrophotographic sensitive material having these merits is superior to, for instance, a selenium sensitive material provided with an intermediate layer consisting of polyvinyl acetate containing of carbon black, as disclosed in Japanese Laid-Open Patent Specification No. 47631/75, is yet to be scrutinized. Nonetheless, the difference of efficiency of the two will be clearly understood from the following descriptions of examples embodying the present invention and comparative examples.

DESCRIPTION OF THE PREFERRED EMBODIMENTS

EXAMPLE 1

A 100 $\mu$-thick stainless steel sheet (to serve as the support) was treated with trichloroethylene to make its surface free of grease, dipped in a methyl ethyl ketone solution containing 10 wt.% of chloroprene rubber (namely, CEMEDINE Ce-560) and then dried at 100° C. for 2 hours in a thermostatic oven, whereby an intermediate layer having a thickness of about 1 $\mu$ was formed thereon (this support is hereinafter called 'support No. 1'). Further, through the same procedure as above save for applying nitrile rubber (namely, CEMEDINE Ce-521) in place of said chloroprene rubber, an intermediate layer having a thickness of about 1 $\mu$ was formed on the same stainless steel sheet as that for support No. 1 (this support is hereinafter called 'support No. 2').

Meanwhile, for the purpose of comparison, by dispersing 5 wt.% of carbon black (a manufacture of CABOT Inc.) in polyvinyl acetate, dipping the same stainless steel sheet as that for support No. 1 in the resulting solution and drying it thereafter, an intermediate layer of about 1 $\mu$ thick was formed (this support is hereinafter called 'support No. 3'). And also, through the same procedure as in preparing said support No. 3 save for omission of the use of carbon black, support No. 4 was prepared. Moreover, support No. 5 and support No. 6 consisting of 100 μ-thick aluminum sheet and 100 μ-thick stainless steel sheet, respectively, were prepared without providing any intermediate layer thereon.

Subsequently, by depositing selenium with a purity of 99.99% on each of these supports No. 1 through No. 6 through vacuum evaporation under the condition of 70° C. in temperature of base sheet, $10^{-5}$ torr in vacuum degree and 1 μ/mm in selenium deposition density, so as to form a 50 μ-thick selenium layer, a variety of photosensitive plates were prepared.

The result of comparison of these photosensitive plates was as shown in the following Table-1. As is evident from the showing in Table-1, the photosensitive materials according to the present invention were excellent in flexibility, free of accumulation of residual potential when used repeatedly, and capable of producing a high-contrast image with little fog.

Table-1

| Photosensitive material | | Cylinder* test | Residual** potential | Characteristics of image*** |
|---|---|---|---|---|
| Example embodying present invention | employing Support No. 1 | 16R | 45V | high-contrast image free of stained ground |
| | Support No. 2 | 16R | 30V | high-contrast image free of stained ground |
| | employing Support No. 3 | 30R | 30V | high-contrast image free of stained ground |
| Comparative Example | Support No. 4 | 25R | 150V | low-contrast image having stained ground |
| | Support No. 5 | 60R | 30V | high-contrast image free of stained ground |
| | Support No. 6 | 65R | 40V | high-contrast image free of stained ground |

(Remarks)
*This test is a test of the mechanical property (namely, the flexibility of photosensitive plate). Each value in the column indicates the diameter of a specific cylinder at the time when the photosensitive layer of a photosensitive plate cracked in the test conducted by closely winding said plate round cylinders having various diameters, and it is utilized as a substitute value expressing the flexibility.
**The residual potential is expressed by the value obtained by repeating 100 times the process comprising electrifying each photosensitive plate under the condition of 5.5KV in discharge voltage and exposing to light of 100 luxes in illumination by the use of Paper Analyzer, the manufacture of KAWAGUCHI DENKI K.K.
***Characteristics Characteristics of image were judged by picking up an image sample by the use of DRY COPYING MACHINE (PPC-900), the manufacture of K.K. RICOH.

EXAMPLE 2

A methyl ethyl ketone solution of chloroprene rubber (namely, CEMEDINE Ce-560) and a tetrahydrofuran solution of polyester (namely, POLYESTER 49000, the manufacture of DU PONT Inc.) were blended so as to make the ratio, by weight, of said chloroprene rubber to polyester 9.5:0.5, 7:3, 5:5, 3:7 and 1:9, respectively, whereby a variety of blended solutions were prepared. Next, by coating each of these blended solutions to the extent of 1 μ in dry thickness on a 100 μ-thick stainless steel sheet treated for removal of grease and drying thereafter, an intermediate layer was formed respectively. Subsequently, by depositing selenium through vacuum evaporation on each of the thus processed stainless steel sheets under the same condition as in Example 1, a variety of photosensitive materials according to the present invention were prepared.

When these photosensitive materials were subjected to said cylinder test, all of them satisfied the value of 13R and displayed a good flexibility superior to a photosensitive material prepared by applying chloroprene rubber alone. However, in the measurement of residual potential, photosensitive materials wherein the ratio of chloroprene rubber to polyester by weight was 9.5:0.5, 7:3 and 5:5, respectively, the value of residual potential was less than 50V, but photosensitive materials wherein said ratio was 3:7 and 1:9, respectively, the value of residual potential was as high as 110V and 140V, respectively.

EXAMPLE 3

Following the same procedure as in Example 2 save for replacing polyester with epoxide resin (namely, BOND-E-SET CLEAR), a variety of photosensitive materials according to the present invention were prepared.

When these photosensitive materials were subjected to said cylinder test, all of them satisfied the value of 13R. However, in the measurement of residual potential, photosensitive materials wherein the ratio of chloroprene rubber to epoxide resin by weight was 9.5:0.5, 7:3, 5:5 and 3:7, respectively, the residual potential satisfied the value of less than 60V, posing no question in practical use, but photosensitive material wherein said ratio was 1:9, the value of residual potential was as high as 120V and, when it was used in copying employing the dry copying machine PPO-900, the resulting copied image showed a lot of stains on the ground.

EXAMPLE 4

Following the same procedure as in Example 2 or Example 3 save for replacing chloroprene rubber with nitrile rubber, a variety of photosensitive materials according to the present invention were prepared. The result of test conducted on these photosensitive materials was similar to that in Example 2 or Example 3.

What is claimed is:

1. An electrophotographic photosensitive member, comprising: an electrically conductive support; an intermediate layer directly overlying and adhered to a surface of said support, said intermediate layer consisting essentially of a rubber component selected from the group consisting of chloroprene rubber, nitrile rubber and blend thereof, said intermediate layer optionally containing up to less than 20% by weight of carbon black; and a photoconductive layer directly overlying and adhered to said intermediate layer, said photoconductive layer consisting mainly of selenium or selenium compound.

2. A member as defined in claim 1 in which the thickness of said intermediate layer is from 0.1 to 5 microns.

3. A member as defined in claim 1 in which said support is flexible.

4. A member as defined in claim 1 wherein said intermediate layer consists of chloroprene rubber.

5. A member as defined in claim 1 wherein said intermediate layer consists of nitrile rubber.

6. An electrophotographic photosensitive member, comprising: an electrically conductive support; an intermediate layer directly overlying and adhered to a surface of said support, said intermediate layer consisting essentially of a blend of (A) a rubber component selected from the group consisting of chloroprene rubber, nitrile rubber and blend thereof, and (B) from 0.5 to 20 parts by weight, per 100 parts by weight of said rubber component, of at least one resin component selected from the group consisting of polyester resin and epoxide resin, said intermediate layer optionally containing up to less than 20% by weight of carbon black; and a photoconductive layer directly overlying and adhered to said intermediate layer, said photoconductive layer consisting mainly of selenium or selenium compound.

7. A member as defined in claim 6 in which the thickness of said intermediate layer is from 0.1 to 5 microns.

8. A member as defined in claim 6 in which said support is flexible.

9. A member as defined in claim 6 in which said rubber component of said intermediate layer consists of chloroprene rubber.

10. A member as defined in claim 6 in which said rubber component of said intermediate layer consists of nitrile rubber.

* * * * *